US005816854A

United States Patent [19]

Baggett et al.

[11] Patent Number: 5,816,854

[45] Date of Patent: Oct. 6, 1998

[54] MOUNTING BRACKET FOR CONNECTOR BLOCK

[75] Inventors: William Calvin Baggett, Duluth, Ga.; Mark George Spaulding, Florham Park; Jeremia Patrick Starace, Nutley, both of N.J.

[73] Assignee: Lucent Technologies Inc., Murray Hill, N.J.

[21] Appl. No.: 442,901

[22] Filed: May 17, 1995

[51] Int. Cl.[6] ..... H01R 13/60

[52] U.S. Cl. ..... 439/540.1; 439/355; 439/719

[58] Field of Search ..... 439/135, 136, 439/709, 716, 718, 719, 355, 540.1

[56] References Cited

U.S. PATENT DOCUMENTS

| | | | |
|---|---|---|---|
| 3,798,587 | 3/1974 | Ellis, Jr. et al. . | |
| 4,171,857 | 10/1979 | Forberg et al. . | |
| 4,283,103 | 8/1981 | Forberg et al. . | |
| 4,729,064 | 3/1988 | Singer, Jr. | 439/716 |
| 4,752,248 | 6/1988 | Rudy, Jr. et al. | 439/709 |

FOREIGN PATENT DOCUMENTS

| | | |
|---|---|---|
| 2017428 | 3/1979 | United Kingdom . |

*Primary Examiner*—Khiem Nguyen
*Assistant Examiner*—Yong Ki Kim

[57] ABSTRACT

A hinged mounting bracket used in conjunction with a telephone wire connecting block for termination of telephone circuit wires. The mounting bracket accepts modular connectors to form any size connecting block. The hinged bracket consists of two pieces, a bracket base and a front flap which receives the modular connectors. In one preferred embodiment, the front flap is coupled to the base by a hinge which enables the bracket to rotate open so that the rear of the modular connectors may be easily accessed. Access to the rear of the connectors at a time after the bracket has been mounted provides additional flexibility in all types of wiring schemes in that the front side of the connecting block may be kept from becoming overly congested. In a preferred application of the invention cable termination are made to the rear of connector modules and the cables enter the bracket through apertures in the base portion of the bracket. The wire access apertures are located at a position relative the termination locations for the cables on the connectors, such that a torsional or twisting force is subjected on cables entering the bracket, rather than a bending force.

21 Claims, 6 Drawing Sheets

FIG. 2B1
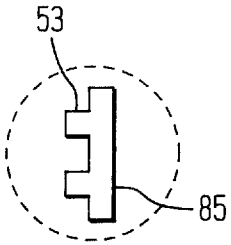
FIG. 2B
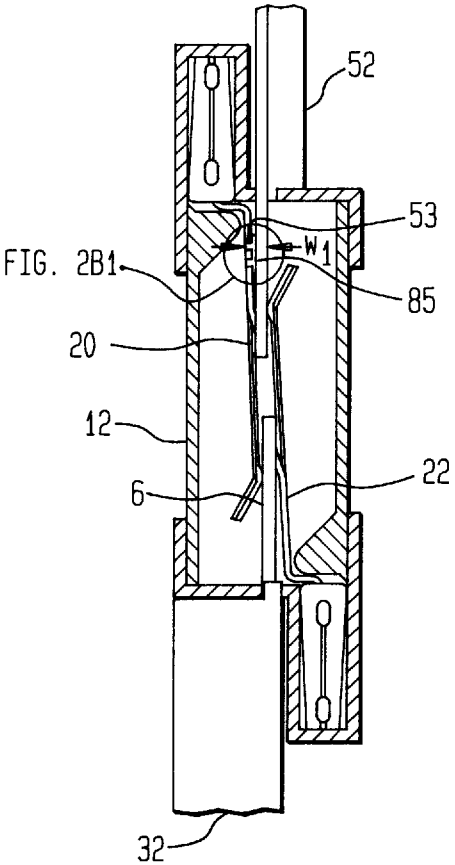
FIG. 2A
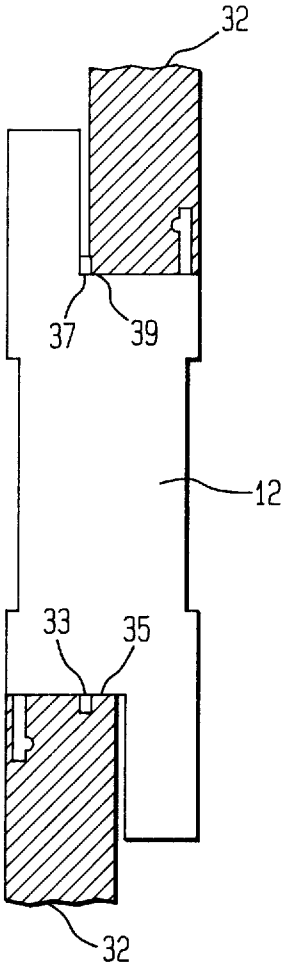

MOUNTING BRACKET FOR CONNECTOR BLOCK

RELATED APPLICATIONS

The present patent application is related to U.S. patent application Ser. No. 08/442,900, entitled Mounting Bracket And Ground Bar For A Connector Block, having a filing date of May 17, 1995, that application having a common assignee and one or more common inventors and being incorporated herein by reference.

FIELD OF THE INVENTION

The present invention relates to a mounting bracket for a telephone circuit connector block, and more particularly to a mounting bracket utilizing a hinged mounting arrangement.

BACKGROUND OF THE INVENTION

Individual pairs of telephone circuit wires are frequently terminated in telephone company central offices, distribution cabinets and customer premise locations, for example, utilizing multi-terminal connector blocks. Once terminated, these telephone circuit wires, usually comprised of cables containing narrow gauge insulated copper conductors, are grouped and then rerouted for appropriate distribution of the calls which they carry. Single connector blocks normally accommodate anywhere from 60 to 100 pairs of densely packed terminations, wherein multiple connector blocks are frequently contained in close proximity at a single location, e.g., one wall of a telephone switching room. Efficient utilization of mounting space is thus required since space within utility locations is traditionally at a premium.

Besides the incoming circuit terminations, the connector blocks are also utilized for making cross-connections between individual circuits on the connector blocks, as well as for mounting of current and voltage limiting circuit protection used to prevent damage caused by lightning and other external forces. For the most part, the terminations, cross-connections and circuit protection are made or applied only at a front facing side of any connector block, this is because the front area is the only area which is easily accessible. Accordingly, the many connections on the front face of a connector block make for a congested wiring arrangement which can be extremely confusing and difficult to decipher for an installer or service person. Utilization of a back facing portion of the connector block could alleviate some of the congestion on the front portion of the connector block, however, the back portion is generally not accessible once the connector block has been mounted.

It is therefore an object of the present invention, to provide an improved mounting bracket for a connector block, wherein front facing and back facing portions of the block area easily accessible for making connections and so forth, even at a time after the block has been mounted.

SUMMARY OF THE INVENTION

The present invention is a selectively openable mounting bracket used in conjunction with a telephone wire connecting block that terminates telephone circuit wires. The mounting bracket is adapted to accept modular connectors in order to form any size connecting block. In one preferred embodiment of the invention, the bracket is hinged and consists of two pieces, a bracket base and a front flap which receives the modular connectors. The front flap is coupled to the base by a hinge which enables the bracket to rotate open so that rear terminals of the modular connectors may be easily accessed. In another preferred embodiment, the front flap is completely removable from the base and is coupled thereto by means of snap-fit connection. Access to the rear of the connectors at a time after the bracket has been mounted provides additional flexibility in all types of wiring schemes in that the front and back side of the connecting block may be continually utilized and kept from becoming overly congested.

In a preferred application of the invention cable termination are made to the rear of connector modules and the cables enter the bracket through apertures in the base portion of the bracket. The wire access apertures are located at a position relative the termination locations for the cables (on the connectors), such that a torsional or twisting force is subjected on cables entering the bracket, rather than a bending force. This type of force minimizes the actual stress on the cables to increase their longevity, while at the same time minimizing stress to the terminals where the cables terminate on the connector. The mounting bracket provides spacing between the modular connectors so that a channel is formed from the space which separates the connectors. Cables which enter the mounting bracket for termination are routed through the channel so as not to interfere with any of the other terminations. Routing of the cables in the channels also provides clear access for inserting surge protector units into the connector modules.

BRIEF DESCRIPTION OF THE FIGURES

For a better understanding of the present invention, reference may be had to the following description of exemplary embodiments thereof, considered in conjunction with the accompanying drawings, in which:

FIG. 2A shows a cross sectional view of a connector module and circuit protector illustrating key and slot exclusion features to ensure proper polarity insertions of circuit protection modules;

FIGS. 2B and 2B1 shows a cross sectional view of a connector module having a circuit protector and a test plug installed;

DETAILED DESCRIPTION OF THE DRAWINGS

Figure 1:
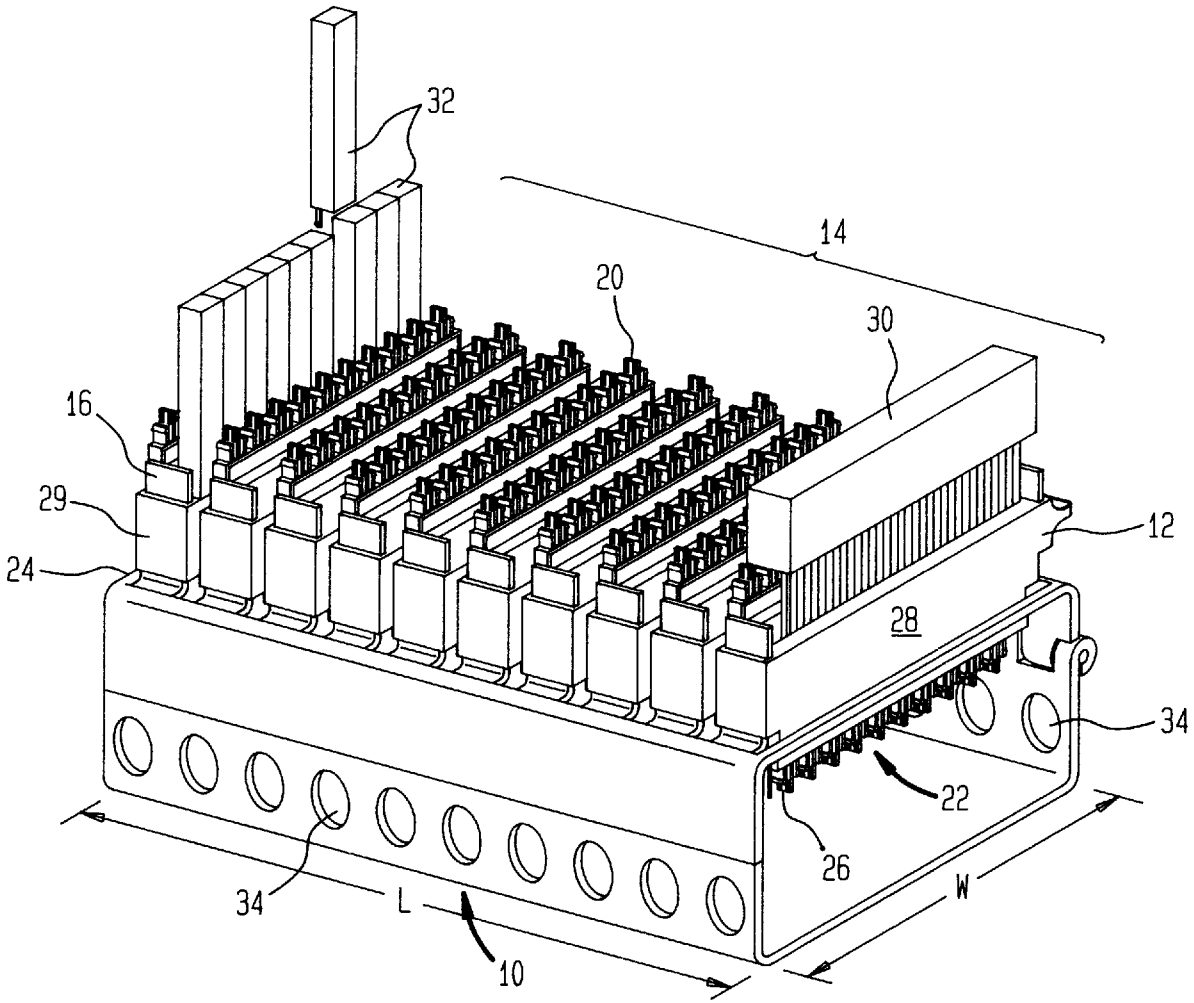
FIG. 1 shows a front perspective view of one preferred embodiment of the present invention mounting bracket, wherein the mounting bracket is populated with connector modules.

The present invention is a mounting bracket adapted to hold double-sided connecting blocks used to terminate telephone circuit wires. Referring to FIG. 1, there is shown one preferred embodiment for the present invention mounting bracket 10. As shown, the mounting bracket 10 is fully loaded with a plurality of connector modules 12 that are inserted into the bracket to make up a connector block 14. The connector modules 12 are insertable into receptacle openings within the mounting bracket 10 and are supported by pairs of posts 16 on either side of the bracket. Sets of terminals 20,22 within the connector modules 12, for example, insulation displacement-type connector terminals, face both to the front side 24 and rear 26 of the mounting bracket. A first connector module 28 is shown with a gas tube protector cartridge 30 mounted thereto, while a last connector module 29 is shown with a plurality of individual protectors 32 for covering single sets of connector terminals 20. Gas tube and other similar-type protectors 30, 32 are known in the art, and in this case, provide protection from excessive voltages or currents on the telephone wires for equipment that is electrically coupled beyond the terminal blocks.

The mounting bracket 10 as shown is in a closed position wherein the closed bracket forms an essentially box-like, rectangular structure. The bracket itself is made from a rigid conductive material, for example, steel or aluminum. In a preferred embodiment of the invention, the mounting bracket has a width W of approximately 4" in order to be mountable on standardized cross-bars and frameworks of the type used in electrical cabinets and utility areas. The length L of the bracket is determined by the number of terminations necessary to be accommodated, with brackets being available in many standard lengths to provide any number of terminations. In a preferred embodiment of the invention the connector modules 12 will be arranged on 0.9 inch centers, resulting in an overall length of 9 inches for a 100 pair connecting block when 10 pair connecting modules are used. Apertures 34 are included on either side of the mounting bracket to facilitate cable insertion and dressing, as will be explained.

Figure 2:
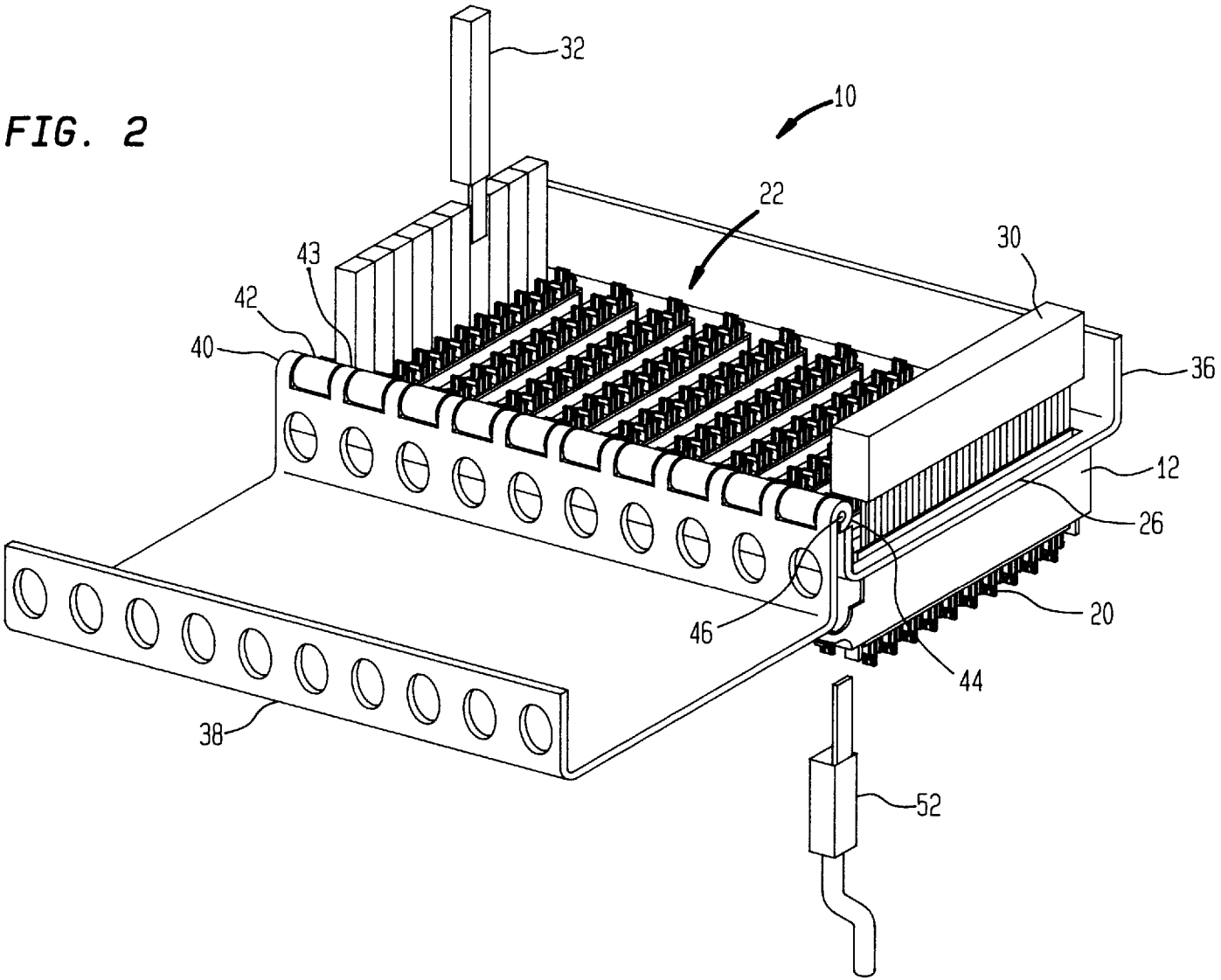
FIG. 2 shows a rear perspective view of the present invention mounting bracket in the open position.

Referring to FIG. 2, an illustration of the present invention mounting bracket 10 is shown from the rear. FIG. 2 illustrates that the mounting bracket 10 is comprised of two separate pieces, a front receptacle piece 36 and a rear bracket base 38. The rear base 38 is coupled longitudinally along a side edge to the front receptacle piece 36 by means of a hinge mechanism 40. In the shown embodiment the hinge mechanism 40 comprises a series of interleaved edges 42, 43 which edges are curled in such a manner so as to define alternating cylindrical hollows 44 within. The hollows are adapted to receive a cylindrical pin 46 or like member in order to align the curled edges 42, 43 and join the two pieces. The front receptacle 36 (or base 38) is then capable of rotating on the hinge 40 in varying degrees from a fully open or closed position. A closure 48 (shown in FIG. 4) may be included so as to secure the front piece 36 into place when closed. Also the interleaved edges 42, 43 may be tightly tolerenced so as to allow rotation only upon exceeding a predetermined torque threshold. In this manner the front receptacle 36 will remain relatively fixed at a desired orientation. Although the shown embodiment utilizes a hinge mechanism to provide pivotal movement for the front of the bracket, it will be understood that other connecting schemes, for example, a form of strap connection, may also be implemented with the present invention bracket. The front receptacle portion may also be completely removable from the base (FIG. 4), wherein the front couples to the base by means of snap-fit or force-fit.

FIG. 2 shows the mounting bracket 10 to be fully stocked with connector modules 12. As can be seen the terminals 22 of the connector modules 12 are completely accessible from the rear when the mounting bracket is in an open position. Continuous accessibility to the rear of the connector modules presents a distinct advantage over mounting brackets of the prior art. The connector modules 12 are also adapted to receive the gas tube protector cartridges 30 and individual protectors 32 at the rear side 26 of the bracket. These protectors shown in first and last positions of the mounting bracket 10 are identical to the protector modules described with respect o FIG. 1.

Referring to FIG. 2A an exclusionary feature to ensure proper polarity insertion of the protection modules 30, 32 is illustrated. A key 33 and slot 35 system is shown within the interior of an individual protector 32 installed on the rear of a connector module 12. Another corresponding key 37 and slot 39 is disposed at one end of an individual protector unit which is installed in the front of a connector module 12. The exclusion feature ensures that current and voltage limiting protector units cannot be installed in the wrong orientation and ensure proper mating and circuit polarity for front and back mounted current and voltage limiting devices 30, 32.

Figure 4:
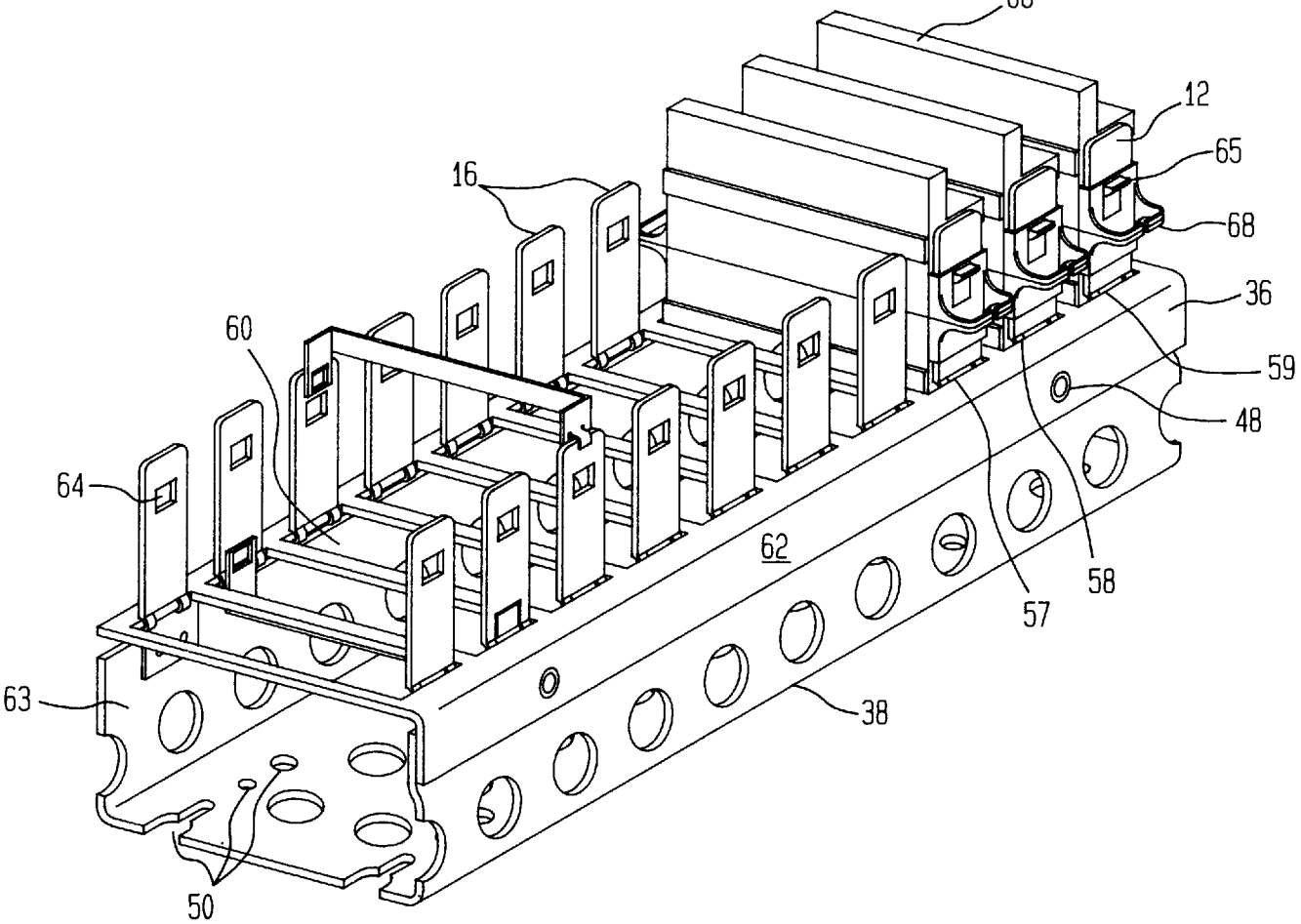
FIG. 4 shows a front perspective view for the present invention mounting bracket, wherein the bracket is partially populated with modular connectors.

As mentioned, the openable mounting bracket 10 provides a significant advantage over the prior art in that the rear of the connector modules 12 which make up the connector block 14 is easily accessible when the front receptacle piece 36 is in the open position. As will be understood, the mounting bracket is mounted at a telephone office or other premises by means of the bracket base. The base 38, as shown in FIGS. 2 and 4 includes a series of apertures 50 in various dimensions comprising a universal mounting arrangement which enable the bracket to attach to a main distributing frame (MDF) on the horizontal or vertical side and to various cross-bars, frameworks and other mounting surfaces.

Cable terminations can then be made on the rear of the connector block 14, wherein the terminations are easily accessed, even after the bracket has been mounted, by swinging open the front portion 36 of the bracket to cause rotation about the hinge 40. Voltage and current protection in the form of the gas tube, solid-state or carbon-type protectors 30, 32 is also easily mountable in the rear of the connector block as shown. By implementing the cable terminations and the circuit protection at the rear 26 of the connector block, terminals 20 on the front 24 of the connector block 14 remain free for cross-connections and to allow access for any testing procedures that need be performed.

Testing of any of the connections is further facilitated in that the connector modules 12 are adapted to receive a test plug 52 at the front or rear of the of the modules to perform testing on each of the terminals 20, 22, both in and out of circuit, without removal of the circuit protection or terminations. Referring to FIG. 2B a connector module 12 is shown having an individual protector 32 installed in the rear of the module and a test plug 52 installed in the front side of the module. A tab 53 is included in a base portion of the conductive element 85 of the test plug of a sufficient width W1, which acts to bias apart the terminals of the connector module when the test plug 52 is inserted. A gap G of predetermined width is created between the front facing terminal 20 of the connector module and the individual protector module 32 when the test plug is inserted. The rear side terminal 22 (or cable termination side) remains coupled to the protector unit. This demonstrates the ability to test bi-directionally utilizing the test plug feature 52, while at the same time maintaining circuit protection on the rear or cable termination side of the connector block.

Figure 5:
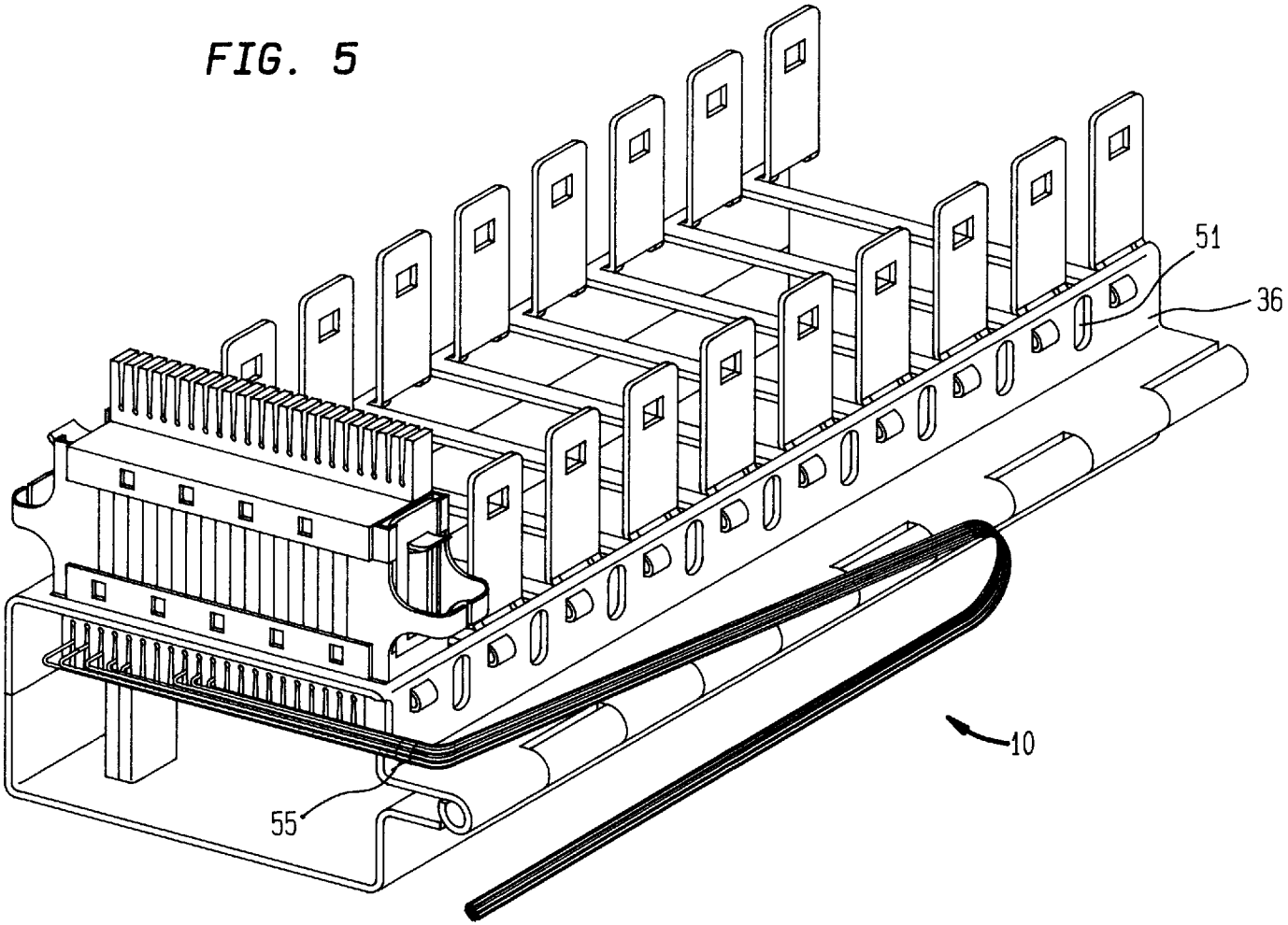
FIG. 5 shows an embodiment of the mounting bracket having apertures on the sides of the front receptacle section.

The present invention mounting bracket 10 improves cable storage, since in the preferred embodiment, circuit terminations are made at the rear 26 of the connector block. The apertures 34, 51 in the sides of the rear of the bracket base 38 as well as in the front receptacle 36 (FIGS. 1 and 5) provide an improved means for dressing of the cables.

Figure 3:
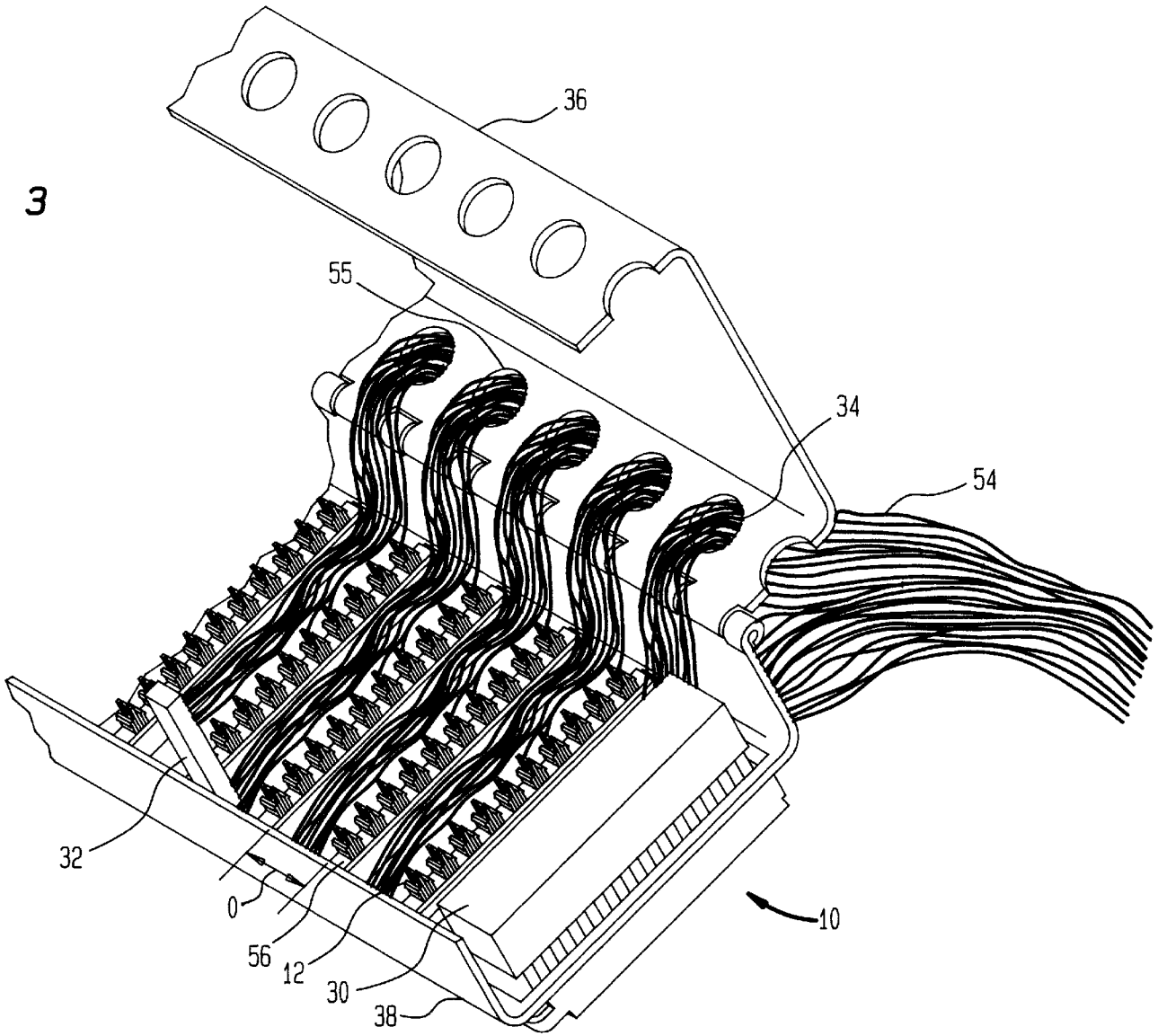
FIG. 3 shows one preferred application for the dressing of cables utilizing the present invention mounting bracket.

Referring to FIG. 3, there is shown a partial view of the mounting bracket having connector modules 12 installed and cables 54 terminated therein. As shown some of the connector modules 12 include protection modules (cartridge 30 and single pair 32) installed in the connectors which cover the respective terminals. As can be seen the wires 54 of the telephone circuit enter the mounting bracket through the apertures 34 in the side of the bracket base 38. A predetermined distance D separates the connector modules 12 wherein the separation between the connector modules forms a channel 56 within which wires entering the mounting bracket are routed to respective terminals for termination. Routing of the conductor cables in channels 56 provides clear access for inserting protector units 30,32 into the connector modules. Moreover, the apertures 34 in the base of the bracket provide an organized arrangement for dressing of the wires. Cables 54 are easily identified and traced to the terminating location since only a fraction of the total conductors enter the bracket through a single aperture. As will be understood, an insulated grommet (not shown) may be included within those apertures through which cables enter in order to guard against cutting of wires caused by sharp edges.

In addition to the advantages already discussed, the present invention hinged mounting bracket 10 provides a means of dressing the conductors within the confines of the bracket wherein a torsional force rather than a bending force is created when the mounting bracket is opened. This torsional force is created because of the location of the entering cables 54 relative the housing of the bracket. Apertures 34 are located close to the point of pivoting when the frame is opened and may even be located on the front portion 36 of the bracket. The apertures 34 (or apertures 51 of FIG. 5) may be offset from the channels 56, wherein the cables enter the mounting bracket and are secured at a point of connection nearest the hinge 40 so that the cable bundle 55 in each aperture rotates in a twisting motion when the bracket is opened, rather than bending. The torsional force is much preferred over a bending force in that cables will remain in tact up to five times longer if subjected to twisting forces as opposed to bending. In addition, this torsional force is subjected on the cable bundle 55 entering the bracket rather than the individual conductors, which minimizes the risk of individual conductors becoming dislodged from the terminals when the bracket is opened.

Referring to FIG. 4, an illustration of the mounting bracket 10 is shown in a closed position, wherein the receptacle portion 36 or top part of the bracket is only partially populated with connector modules 12. In this figure, only the last three slots 57, 58, 59 of the mounting bracket are shown with connector modules 12 mounted therein. FIG. 4 more clearly illustrates the support posts 16 and associated openings 60 of the receptacles in the bracket. The support posts 16 found on either side of the mounting bracket extend vertically upward and are oriented parallel to the sides 62, 63 of the mounting bracket. In a preferred embodiment of the invention, the support posts are generally thin rectangular members, wherein each of the support posts includes a rectangular opening 64 disposed centrally within the post 16. The openings 64 are adapted to receive a fastening tab 65 on the connector module 12 for securing the connector in place within the bracket 10. It will also be understood that connector modules 12 may be inserted within the bracket in an upside down fashion if the application necessitates. In this case a front side of the connector module 12 would face the base 38 of the bracket. This type of insertion may be accomplished since the parts are symmetrical. The connector modules of FIG. 4 are shown with a terminal cap 66 mounted thereon for covering of the exposed terminals. Also included on the connector module is a fanning strip 68. The fanning strip 68 is adapted to receive conductor cables which are run to the terminals and help to facilitate orderly cable dressing.

From the above, it should be understood that the embodiments described, in regard to the drawings, are merely exemplary and that a person skilled in the art may make variations and modifications to the shown embodiments without departing from the spirit and scope of the invention. All such variations and modifications are intended to be included within the scope of the invention as defined in the appended claims.

What is claimed is:

1. A bracket apparatus for mounting a connecting block used to terminate wires, said connecting block being formed from a plurality connector modules, wherein said connecting modules include a plurality of connector terminals on a front and rear side thereof for termination of said wires, said bracket apparatus comprising:

front receptacle flap including a plurality of receptacle areas, said receptacle areas being adapted to securably receive said connector modules, wherein said terminals on said front side of said connecting modules face a front side of said receptacle flap;

rear mounting plate adapted for fixed mounting of said bracket apparatus to a nominally planar surface; and coupling means for attachment of said front receptacle flap to said mounting plate, wherein said front flap is openable relative said mounting plate to thereby enable access to said rear side terminals of said connecting modules when said bracket apparatus is mounted and said front flap is in an open position, wherein said front receptacle flap and said rear mounting plate are generally U-shaped when viewed in a transverse cross section, wherein said front flap and said mounting plate couple together in a closed position to create a generally rectangular cross section defining an interior hollow, and wherein said wires enter said interior hollow for termination at said rear side terminals of said connecting modules.

2. The apparatus of claim 1, wherein said coupling means is a hinge.

3. The apparatus of claim 2, wherein said hinge comprises interleaved edges extending from said front flap and said mounting plate, said interleaved edges being curled to define a hollow therein, wherein said hollows are aligned and coupled together to form said hinge.

4. The apparatus of claim 1, wherein said mounting plate includes mounting means for universal mounting of said plate to telephone circuit main distribution frames.

5. The apparatus of claim 4, wherein said mounting means includes a plurality of varying sized apertures extending through said mounting plate, said apertures positioned to form said universal mounting arrangement.

6. A bracket apparatus for mounting a connecting block used to terminate wires, said connecting block being formed from a plurality connector modules, wherein said connecting modules include a plurality of connector terminals on a front and rear side thereof for termination of said wires, said bracket apparatus comprising:

front receptacle flap including a plurality of receptacle areas, said receptacle areas being adapted to securably receive said connector modules, wherein said terminals on said front side of said connecting modules face a front side of said receptacle flap;

rear mounting plate adapted for fixed mounting of said bracket apparatus to a nominally planar surface; and coupling means for attachment of said front receptacle flap to said mounting plate, wherein said front flap is openable relative said mounting plate to thereby enable access to said rear side terminals of said connecting modules when said bracket apparatus is mounted and said front flap is in an open position, wherein said connector modules are alignable in parallel to form a single row within said front receptacle flap, said connector modules being separated in said receptacle flap by a predetermined distance, wherein said predetermined distance between said connector modules creates a channel, whereby said wires being terminated at said connector modules may be routed within said channels.

7. The apparatus of claim 6, wherein said mounting plate includes a series of receiving apertures disposed on either side thereof wherein each of said receiving apertures corresponds to a channel within said front plate, wherein an aperture is positioned relative said channel such that said wires entering said bracket apparatus through said aperture are subjected to a torsional force when said front plate is opened.

8. The apparatus of claim 6, wherein said front receptacle flap is adapted to reversibly receive said connector modules, said connector modules being insertable wherein said front side of said connector module may also face said mounting plate.

9. A bracket apparatus for mounting a connecting block used to terminate wires, said connecting block being formed from a plurality connector modules, wherein said connecting modules include a plurality of connector terminals on a front and rear side thereof for termination of said wires, said bracket apparatus comprising:

front receptacle flap including a plurality of receptacle areas, said receptacle areas being adapted to securably receive said connector modules, wherein said terminals on said front side of said connecting modules face a front side of said receptacle flap;

rear mounting plate adapted for fixed mounting of said bracket apparatus to a nominally planar surface; and coupling means for attachment of said front receptacle flap to said mounting plate, wherein said front flap is openable relative said mounting plate to thereby enable access to said rear side terminals of said connecting modules when said bracket apparatus is mounted and said front flap is in an open position, wherein said front receptacle plate includes a plurality of outwardly projecting support posts located at each side thereof, said front plate further including a row of generally rectangular slots disposed adjacent said support posts, wherein a single slot and pair of said support posts on either side of said plate define a receptacle area for insertion of a single one of said connector modules.

10. The apparatus of claim 9, wherein said support posts are generally flat rectangular members, said support posts having an aperture defined therein for lockably receiving said connector modules.

11. A bracket apparatus for mounting a connecting block used to terminate wires, said connecting block being formed from a plurality connector modules, wherein said connecting modules include a plurality of connector terminals on a front and rear side thereof for termination of said wires, said bracket apparatus comprising:

front receptacle flap including a plurality of receptacle areas, said receptacle areas being adapted to securably receive said connector modules, wherein said terminals on said front side of said connecting modules face a front side of said receptacle flap;

rear mounting plate adapted for fixed mounting of said bracket apparatus to a nominally planar surface; and coupling means for attachment of said front receptacle flap to said mounting plate, wherein said front flap is openable relative said mounting plate to thereby enable access to said rear side terminals of said connecting modules when said bracket apparatus is mounted and said front flap is in an open position, wherein said coupling means includes a force-fit arrangement, wherein said front receptacle flap snaps onto said mounting plate, said flap being removable.

12. A mounting bracket apparatus for use with a modular connecting block to terminate wires, wherein said modular connecting block includes terminals on a front and rear facing side thereof, said mounting bracket device comprising:

receiving platform means for securably receiving said modular connecting block; and mounting plate means including a universal mounting arrangement for fixed mounting of said bracket device, said mounting plate means and said receiving platform means being couplable to one another to form a single longitudinal member, and wherein said receiving platform means is removably attached relative said mounting plate thereby enabling access to said rear facing side of said connecting block when said bracket is in an open position, wherein said receiving platform means and said mounting plate means are generally U-shaped when viewed in a transverse cross section, wherein said platform means and said plate means couple together in a closed position to create a generally rectangular structure defining an interior hollow, and wherein said telephone circuit wires enter said interior hollow for termination at said rear side terminals of said connecting block.

13. A mounting bracket apparatus for use with a modular connecting block to terminate wires, wherein said modular connecting block includes terminals on a front and rear facing side thereof, said mounting bracket device comprising:

receiving platform means for securably receiving said modular connecting block; and mounting plate means including a universal mounting arrangement for fixed mounting of said bracket device, said mounting plate means and said receiving platform means being couplable to one another to form a single longitudinal member, and wherein said receiving platform means is removably attached relative said mounting plate thereby enabling access to said rear facing side of said connecting block when said bracket is in an open position, wherein said connecting block is comprised of a plurality of connector modules, said connector modules being aligned in parallel to form a single row within said receiving platform means, said connector modules being separated in said receiving platform means by a predetermined distance, wherein said predetermined distance between said connector modules creates a channel, whereby said telephone wires being terminated at said connector modules may be routed within said channels.

14. The apparatus of claim 13, wherein said front receiving platform means includes a plurality of outwardly projecting support posts located at each side thereof, said receiving platform further including a row of generally rectangular slots disposed between said support posts, wherein a single slot and pair of said support posts on either side of said platform define a receptacle area for insertion of a single one of said connector modules.

15. The apparatus of claim 14, wherein said support posts are generally flat rectangular members, said support posts having an aperture defined therein for lockably receiving said connector modules.

16. The apparatus of claim 13, wherein said mounting plate means includes a series of receiving apertures disposed on either side thereof wherein each of said receiving apertures corresponds to a channel within said plate, wherein an aperture is positioned relative said channel such that said wires entering said bracket apparatus through said aperture are subjected to a torsional force when said front plate is opened.

17. The apparatus of claim 13, wherein said receiving platform means and said mounting plate means are coupled together utilizing a hinge mechanism.

18. The apparatus of claim 17, wherein said hinge comprises interleaved edges extending from said receiving platform and said mounting plate, said interleaved edges being curled to define a hollow therein, wherein said hollows are aligned and coupled together to form said hinge.

19. The apparatus of claim 13, wherein said mounting plate means includes mounting means for universal mounting of said plate to telephone circuit main distribution frames.

20. The apparatus of claim 19, wherein said mounting means includes a plurality of varying sized apertures extending through said mounting plate, said apertures positioned to form said universal mounting arrangement.

21. The apparatus of claim 13, wherein said platform means and said mounting plate means are coupled together in a force-fit arrangement.

* * * * *